US007836707B2

(12) United States Patent
Puranen et al.

(10) Patent No.: US 7,836,707 B2
(45) Date of Patent: Nov. 23, 2010

(54) METHODS FOR DETECTING AND RESPONDING TO FREEZING COILS IN HVAC SYSTEMS

(75) Inventors: Chris Puranen, Noblesville, IN (US); Rajendra K. Shah, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 773 days.

(21) Appl. No.: 11/646,674

(22) Filed: Dec. 28, 2006

(65) Prior Publication Data

US 2007/0234746 A1 Oct. 11, 2007

(51) Int. Cl.

| | |
|---|---|
| ***F25D 21/00*** | (2006.01) |
| ***F25D 21/06*** | (2006.01) |
| ***F25D 21/02*** | (2006.01) |
| ***F25D 17/00*** | (2006.01) |
| ***G01K 13/00*** | (2006.01) |
| ***F25B 1/00*** | (2006.01) |

(52) U.S. Cl. ..... 62/80; 62/129; 62/151; 62/155; 62/140; 62/180; 62/226; 62/234

(58) Field of Classification Search ..... 62/80, 62/129, 151, 155, 140, 180, 226, 234
See application file for complete search history.

(56) References Cited

U.S. PATENT DOCUMENTS

| | | | | |
|---|---|---|---|---|
| 4,831,833 | A * | 5/1989 | Duenes et al. | 62/140 |
| 5,170,635 | A * | 12/1992 | Wruck et al. | 62/151 |
| 5,463,875 | A * | 11/1995 | Shavit | 62/140 |
| 2006/0130497 | A1 * | 6/2006 | Kang et al. | 62/127 |

OTHER PUBLICATIONS

"Establishing Cooling Requirements: Air Flow vs Pressure" www.comairrotron.com/engineering_notes_02.asp. Dated May 15, 2004.*

* cited by examiner

*Primary Examiner*—Frantz F Jules
*Assistant Examiner*—Travis Ruby
(74) *Attorney, Agent, or Firm*—Cantor Colburn LLP

(57) ABSTRACT

A method to detect and respond to a coil condition in an HVAC system. The method includes calculating an initial airflow restriction value and a current airflow restriction value, which are compared. If the current airflow restriction value is greater than a first sum including the initial airflow restriction value and a first restriction factor, then a coil condition is preliminarily determined to be freezing and cooling in the HVAC system is stopped.

15 Claims, 2 Drawing Sheets

METHODS FOR DETECTING AND RESPONDING TO FREEZING COILS IN HVAC SYSTEMS

BACKGROUND OF THE INVENTION

1. Field of the Invention

The present disclosure relates to cooling systems, such as a heating, ventilation, and air conditioning systems (hereinafter "HVAC systems"). More particularly, the present disclosure relates to methods for detecting and responding to a freezing or frozen coil in HVAC systems.

2. Description of the Related Art

HVAC systems are well known in the art and are implemented in office buildings and residential settings. The freezing of a coil in an HVAC system is a problem that exists among all HVAC systems. The freezing of a coil can adversely affect the efficiency of the HVAC system, and prolonged or repeated freezing can cause system breakdowns or compressor damage.

HVAC systems generally are well-known, and a typical HVAC system can include, for example, components such as conduits ("ducts" or "duct systems"), air conditioners, compressors, heating elements, heat exchangers, filters, louvers (for controlling airflow to and from the exterior environment), blower fans, and airflow hoods. Simple HVAC systems can be designed employing a number of methods, including the equal friction method, the constant velocity method, the velocity reduction method, and the static regain method.

Evaporator or indoor coils used in HVAC systems have a tendency to freeze and ice can accumulate on the coil due to environmental factors and/or malfunctions in the HVAC system. When ambient outside temperatures are low, and the cooling cycling is still required for the indoor or working fluid, the coil can freeze and lead to the buildup of ice. Similarly, malfunctions in the HVAC system, such as low refrigerant or a leak of refrigerant, can lead to coil freezing.

Thermostats or sensors placed on the coil are the typical methods for detecting ice buildup. This technology, however, fails to provide comprehensive coil freezing detection and protection from the deleterious effects of this problem.

Therefore, there exists a need for methods for detecting and responding to freezing or frozen coils in HVAC systems that overcome, mitigate, and/or alleviate one or more or other deleterious effects and deficiencies of the prior art.

SUMMARY OF THE INVENTION

The present disclosure provides a method to detect and respond to a coil condition in an HVAC system. The method includes calculating an initial airflow restriction value and a current airflow restriction value, which are compared. If the current airflow restriction value is greater than a first sum including the initial airflow restriction value and a first restriction factor, then a coil condition is preliminarily determined to be freezing and cooling in the HVAC system is stopped.

The present disclosure further provides a method to detect and respond to a coil condition in an HVAC system, which has multiple zones. The method includes calculating an initial airflow restriction value and a current airflow restriction value for the HVAC system, where the HVAC system has multiple zones. The multiple zones are factored into the calculation of the initial and the current airflow restriction. The initial airflow restriction value is compared to the current airflow restriction value. If the current airflow restriction value is greater than a first sum including the initial airflow restriction value and a first restriction factor, then the coil condition is preliminarily determined to be freezing and cooling in the HVAC system is stopped.

The present disclosure provides a method for detecting and responding to a freezing coil in an HVAC system.

The present disclosure also provides a for detecting and responding to a coil condition in an HVAC system by monitoring the airflow in the HVAC system, and correlating an increase in airflow restriction in the system with a potentially frozen coil.

The present disclosure further provides a HVAC system check protocol that considers other factors that can cause an increase in airflow restriction before positively determining that the coil is freezing.

The present disclosure still further provides a method that responds to a coil that has been confirmed as frozen, by causing the system to enable the thawing of the frozen coil.

The present disclosure also provides a method for detecting and responding to a freezing coil in a zoned HVAC system by correlating an increase in airflow restriction in the zoned HVAC system with a potentially frozen coil.

BRIEF DESCRIPTION OF THE DRAWINGS

These and other advantages and benefits of the present disclosure will be more apparent from the followed detailed description of the present disclosure, in conjunction with the accompanying drawings wherein.

DETAILED DESCRIPTION OF THE PREFERRED EMBODIMENTS

Figure 1:
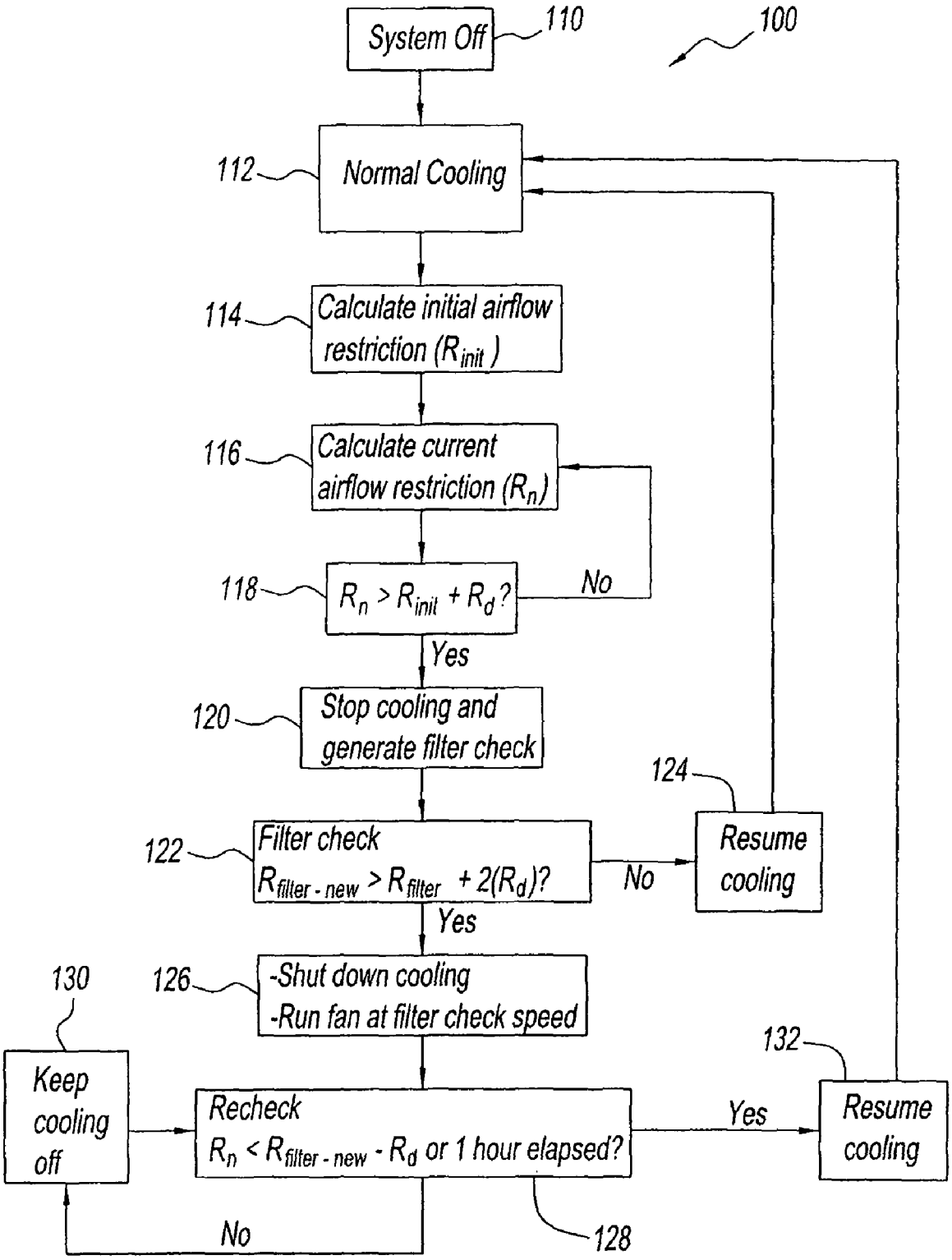
FIG. 1 is an exemplary embodiment of the present disclosure, which shows a flowchart demonstrating steps in a method for detecting and responding to a frozen coil in an HVAC system according to the present disclosure.

In FIG. 1, a flowchart demonstrates steps in the method 100 for detecting and responding to a frozen coil in an HVAC system. The detection method disclosed has several steps that calculate periodic airflow restriction values and compare these values to initial baseline values to determine whether the HVAC system has a frozen coil.

Method 100 begins with the HVAC system initially in the off position as indicated in step 110. The HVAC system starts and in step 112 a normal cooling cycle begins. After the HVAC system has started and normal cooling has run for a period of time, which could be approximately two minutes, step 114 is conducted and the initial airflow restriction of the HVAC system ($R_{init}$) is calculated. Several methods can be used to detect the initial airflow restriction in an HVAC system. In one exemplary embodiment, $R_{init}$ can be calculated using the following equation:

$$R_{init} = \frac{\text{Static Pressure } (SP)}{(CFM(\text{cubic ft/min})/1000)^2}$$

Where CFM is the airflow in cubic feet per minute in the HVAC system and static pressure is the pressure drop across the restriction. Static pressure (SP) can be calculated as a function of the delivered air flow, and the sensed fan motor speed, taken with constants characterizing the particular components of the HVAC system in a known manner.

The $R_{init}$ can be calculated at any time. For example, the $R_{init}$ can be calculated when the HVAC system is first started and/or calculated once per day. The $R_{init}$ provides a baseline against which future airflow restriction calculations can be gauged. The $R_{init}$ can be stored within a memory component of the HVAC system, which can be accessed and retrieved when needed.

The measuring technique described here to calculate the $R_{init}$ is just one way of many to calculate the $R_{init}$. Attempts should be made, however, to remove any airflow/static pressure measurement variations that can be introduced by changes in: duct registers, accumulated filter dirt, damper movements in a zoned HVAC system, and desired system airflow changes.

After the $R_{init}$ has been calculated in step 114, periodic calculation of the most current airflow restriction value ($R_n$) is conducted in step 116. The frequency of the calculation of the $R_n$ value can be approximately every five minutes; however, the period between each $R_n$ value calculation can be greater or less than five minutes.

In step 118, the periodic $R_n$ value is compared to $R_{init}+R_d$. Where $R_d$=Static Pressure (SP) of 0.2 inches of $H_2O$/(CFM (cubic ft./min)/1000)$^2$. The calculation of $R_d$ is calculated using a set SP of 0.2 inches of $H_2O$, but this set value could be any value within a range of 0.1 to 0.5 inches $H_2O$.

The query in step 118 asks the question whether $R_n$ is greater than $R_{init}+R_d$. If $R_n$ is greater than $R_{init}+R_d$ at step 118, then method 100 makes a preliminary determination that the coil in the HVAC system is possibly freezing or frozen.

However, if $R_n$ is less than $R_{init}+R_d$, then method 100 determines that the coil is not frozen and the current airflow restriction $R_n$ is recalculated in step 116 and the calculation in step 118 is performed again. If $R_n$ continues to be less than $R_{init}+R_d$, then method 100 will continue to monitor the HVAC system, allowing cooling upon demand, and steps 116 and 118 will continue to be performed to check for a freezing coil periodically.

If $R_n$ is greater than $R_{init}+R_d$ such that the preliminarily determination that the coil is freezing or frozen was made, method 100 moves on to step 120. Step 120 causes the HVAC system to stop cooling and generate a filter check to determine the current filter check airflow restriction value. Several factors besides a frozen coil can generate an increase in airflow restriction. One major factor that can increase airflow restriction and signal a possible freezing or frozen coil is a clogged or dirty filter. For this reason, method 100 adjusts for this possibility by reducing the potential for the filter variable affecting the detection of a frozen coil at steps 120 and 122.

In step 122, a filter check is done to reduce the possibility that the increase in airflow restriction in the HVAC system was caused by a dirty or clogged filter. The filter check of step 122 can be performed in a known manner to determine a baseline filter check airflow restriction value ($R_{filter}$) and a current filter check airflow restriction value ($R_{filter\text{-}new}$). Here, step 122 can determine the routine filter check airflow restriction value ($R_{filter}$) on a regular basis, such as daily, and is the baseline value for the system. A memory component can be used to store this baseline value the HVAC system, which can be accessed and retrieved when needed. Additionally, step 122 determines the $R_{filter\text{-}new}$ value based on data collected at the time that the frozen coil was preliminarily detected at step 118

In step 122, method 100 compares the stored filter check value ($R_{filter}$) to the ($R_{filter\text{-}new}$) value. Specifically, method 100 makes a comparison of $R_{filter\text{-}new}>R_{filter}+2(R_d)$. The $R_d$ value is calculated using the previous disclosed formula. The $R_{filter}$ and $R_{filter\text{-}new}$ values can be calculated using the following equation:

$$R_{filter} = \frac{\text{Filter Static Pressure } (SP)}{(\text{Filter } CFM(\text{cubic ft.}/\text{min})/1000)^2}$$

The $R_{filter\text{-}new}$ value is calculated at a time just after the preliminary determination that the coil is freezing, and $R_{filter\text{-}new}$ is determined using the equation identical to the equation above for $R_{filter}$. Thus, the values of the Filter SP and the Filter CFM are unique to the time when $R_{filter\text{-}new}$ is being measured, i.e., the values of the variables are taken soon after step 120 in response to a preliminary frozen coil detection.

If the filter check step 122 determines that $R_{filter\text{-}new}$ is greater than $R_{filter}+2(R_d)$, then method 100 confirms the preliminary determination that the coil was frozen made at step 118 and the method maintains the HVAC system shut down at step 126. In response to confirmation that the coil is frozen at step 122, the method can generate an error message that can be displayed on a user interface informing the user that the coil is frozen. The information generated by the frozen coil confirmation can also be stored a memory unit in the HVAC system, which can be used in diagnostic tests.

If the filter check step 122 determines that $R_{filter\text{-}new}$ is not greater than $R_{filter}+2(R_d)$, then method 100 controls the HVAC system to resume cooling as indicated in step 124. In this manner, step 124 can restart normal cooling of the HVAC system when determination that the coil is not frozen is made at step 122.

In some embodiments, method 100 can operate the fan in the HVAC system is run at a filter check speed during step 126. Running the fan will assist in defrosting a frozen coil.

As indicated in step 130, cooling remains shut down in the HVAC system until one of the conditions in step 128 are satisfied. For example, cooling can resume if $R_n<R_{filter\text{-}new}-R_d$ or one hour has elapsed, as indicated in step 128. Either of these conditions can lead to the resumption of cooling in the HVAC system and progression to step 132, and ultimately progression to step 112 and normal cooling.

If, however, $R_n$ is greater than $R_{filter\text{-}new}-R_d$ at step 128, than cooling remains off as shown at step 130. Method 100 continuously or periodically measures the $R_n$ value and compares $R_n$ to $R_{filter\text{-}new}-R_d$ until one of the conditions in step 128 is satisfied. Should $R_n$ be less than $R_{filter\text{-}new}-R_d$, this is an indication that the previously frozen coil is no longer frozen, i.e., airflow restriction has decreased, and that normal cooling can restart as shown in step 132.

Figure 2:
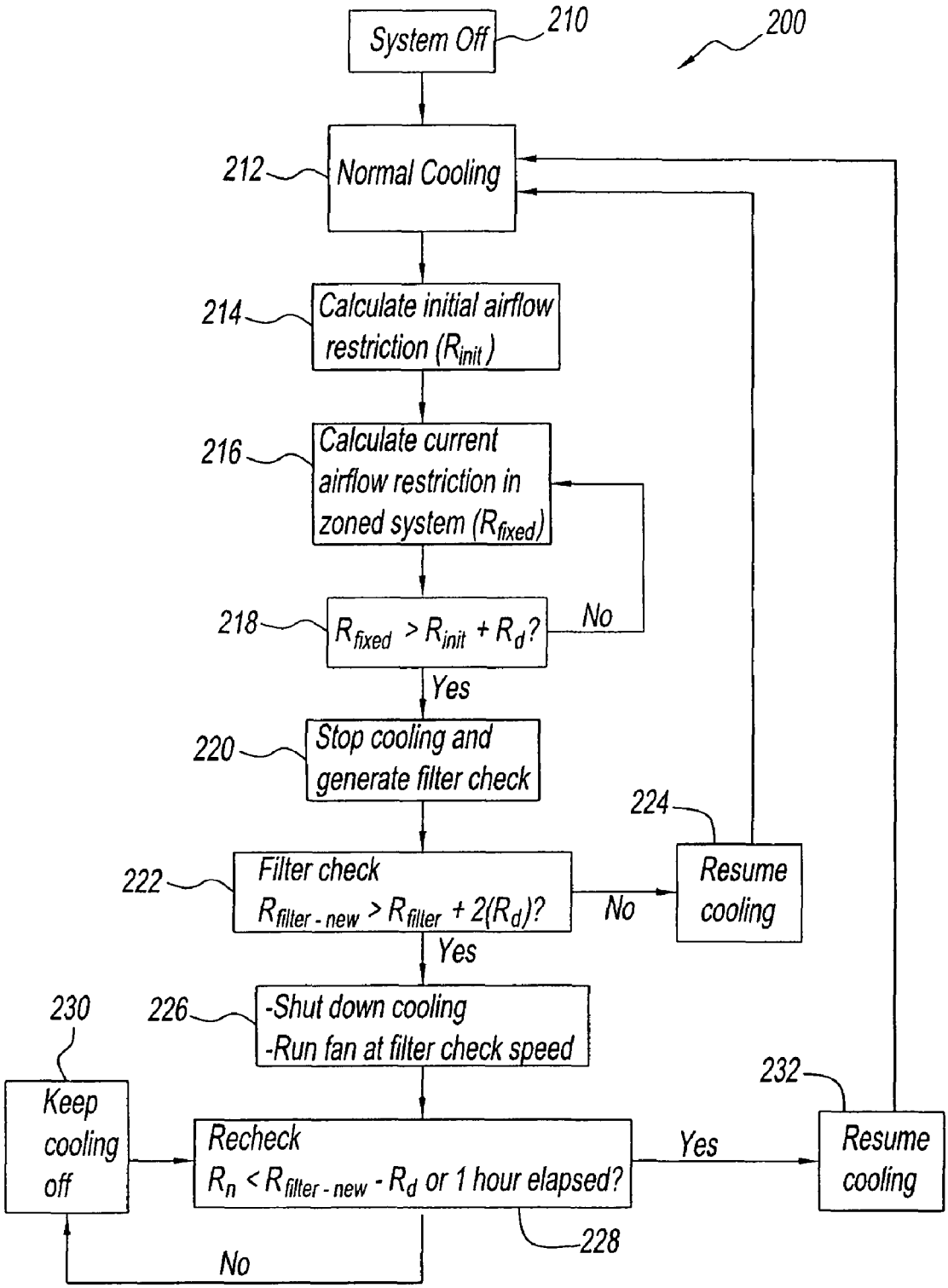
FIG. 2 is a flowchart of an alternative exemplary embodiment of the present disclosure, which shows a method for detecting and responding to a frozen coil in a zoned HVAC system.

FIG. 2 represents an alternative embodiment of the present disclosure, which shows a method 200 for detecting and responding to a frozen coil in a zoned HVAC system. A zoned HVAC system is a system that uses dampers to close or open one or more duct work sections within the system. Dampers enable a user to direct airflow to only the sections where airflow is desired. The change in position of the dampers can influence the airflow restriction of the HVAC system. An HVAC system with dampers increases the complexity in determining airflow restriction values. Therefore, several equations are used to factor in the variability of a zoned HVAC system.

Method 200 starts with step 210 with the HVAC system off. In step 212, normal cooling begins and an initial airflow restriction ($R_{init}$) is calculated in step 214. In some aspects, $R_{init}$ is calculated approximately two minutes after the HVAC system starts. The $R_{init}$ value can be calculated at a set time each day and stored in a memory device. The stored $R_{init}$ value can be accessed and retrieved for use in the future, i.e., for further HVAC system calculations. $R_{init}$ is the Static Pressure (SP)/CFM/1000)$^2$.

After the $R_{init}$ value is calculated, the current airflow restriction in a zoned HVAC system ($R_{fixed}$) is calculated in step 216. To calculate $R_{fixed}$ in a zoned HVAC system several initial values are calculated. Specifically, the following values are used in calculating $R_{fixed}$: $R_d$, $R_{total}$, $R_{da\text{-}open}$, $R_{da\text{-}fixed}$, % Open, and $R_z$. $R_d$ is calculated similarly to the $R_d$ value used in the unzoned calculations, i.e., $R_d$=Static Pressure (SP) of 0.2 inches of $H_2O$/(CFM (cubic ft./min)/1000)$^2$.

The calculation of $R_d$ is calculated using a set SP of 0.2 inches of $H_2O$, but this value could be any value within a range of 0.1 to 0.5 inches $H_2O$.

The current active airflow restriction on the HVAC system during cooling, $R_{total}$, is calculated using the following equation: Static Pressure (SP)/(CFM/1000)$^2$. The same equation is used to calculate $R_{init}$. However, the calculation of $R_{init}$ is performed to set a baseline value for airflow restriction in the HVAC system, while $R_{total}$ is calculated periodically to assess the current airflow restriction and is used to compute whether it is increasing. Since $R_{init}$ is only used to set a baseline restriction value it can be calculated only once a day.

The $R_{da\text{-}open}$ and $R_{da\text{-}fixed}$ are values determined during a zoning duct assessment and these values will not change. The $R_{da\text{-}open}$ is the airflow restriction on the HVAC system with all dampers open. The $R_{da_fixed}$ is the airflow restriction on the HVAC system due to the furnace or fan coil itself, i.e., restriction from the heat exchanger, coils, blower housing, etc.

The $R_{da\text{-}open}$ and $R_{da\text{-}fixed}$ values can be calculated using the following respective equations:

$$R_{da-open} = \frac{\text{Static Pressure } (SP) \text{ (all zones open)}}{(DA\ CFM/1000)^2}$$

$$R_{da-fixed} = \frac{\text{Fixed Static Pressure } (SP)}{(DA\ CFM/1000)^2}$$

The number of dampers in an HVAC system, the zone size and the position of the dampers are all variables that can influence the airflow restriction of a zoned HVAC system. These variables can be accounted for using the following equation to determined the percentage of the dampers open: % Open=Σ[((Zone Size (i))((Damper Position)(i)/15)]+Closed Size.

Using the values generated from the equations above it is possible to calculate airflow restriction of a zoned HVAC system using the following equation:

$$R_z = \frac{R_{da-open} - R_{da-fixed}}{(\%\text{Open})^2}$$

From that value it is possible to determine the fixed airflow restriction of the HVAC system $R_{fixed}$, which has factored in the effect of the dampers, the positioning of the dampers, the zone size, etc.: $R_{fixed}=R_{total}-R_z$. With the $R_{fixed}$ value it is possible to move on to step 218 where the $R_{fixed}$ value is compared to the sum of $R_{init}$ and $R_d$.

In accordance with step 218, if $R_{fixed}>R_{init}+R_d$, then the method proceeds to step 220 and cooling in the HVAC system is stopped and a filter check is generated. If $R_{fixed}<R_{init}+R_d$, then the method does not proceed to step 220, rather, $R_{fixed}$ is recalculated and step 218 is performed again. This loop between steps 216 and 218 continues periodically with the $R_{fixed}$ value being calculated and compared to $R_{init}+R_d$ with a frequency of approximately five minutes. However, the frequency of the calculations can vary from this suggested value. This loop between steps 216 and 218 can continue throughout normal cooling.

Progression to step 220 is a preliminary indication that the coil is frozen. However, as discussed previously concerning method 100 the preliminary determination that the coil is frozen must be confirmed in step 222. After cooling is stopped in step 220, a filter check is performed in step 222 to confirm that the coil is indeed frozen. Confirmation occurs if $R_{filter\text{-}new}>R_{filter}+2(R_d)$, and the method progresses to step 226. The value of a routine dirty filter check airflow restriction value ($R_{filter}$) is compared to the value of a current dirty filter check airflow restriction value ($R_{filter\text{-}new}$) that was calculated at the time that the preliminary frozen coil was detected. Specifically, if $R_{filter\text{-}new}>R_{filter}+2(R_d)$, then cooling remains off. The routine dirty filter check can be performed at a time in advance of the comparison of the $R_{filter}$ value to the $R_{filter\text{-}new}$ value. $R_d$ is calculated using the previous disclosed formula for $R_d$. $R_{filter}$ can be calculated using the previously discussed formula used in the unzoned method 100.

The $R_{filter\text{-}new}$ is calculated at a time just after the preliminary determination that the coil is freezing, and $R_{filter\text{-}new}$ is determined using the equation identical to the equation above for $R_{filter}$. However, the values of the Filter SP and the Filter CFM are unique to the time when $R_{filter\text{-}new}$ is being measured, i.e., the values of the variables are taken soon after step 220.

If the filter check determines that $R_{filter\text{-}new}$ is not greater than $R_{filter}+2(R_d)$, then cooling in the HVAC system is resumed as indicated in step 224. A determination that the coil is not frozen will lead to step 212 restarting normal cooling. However, if it is determined at step 222 that $R_{filter}$ new is greater than $R_{filter}+2(R_d)$, then cooling remains shut off and the fan in the HVAC system is run at filter check speed. Running the fan will assist in defrosting a frozen coil. As indicated in step 230, cooling remains shut down in the HVAC system until one of the conditions in step 228 is satisfied.

Cooling can resume if $R_n<R_{filter\text{-}new}-R_d$ or one hour has elapsed, as indicated in step 228. Either of these conditions can lead to the resumption of cooling in the HVAC system and progression to step 232 and ultimate progression to step 212 and restart of normal functioning of the HVAC system. If, however, $R_n>R_{filter\text{-}new}-R_d$, than cooling remains off. Periodic measurement of the $R_n$ value and comparison of $R_n$ to $R_{filter\text{-}new}-R_d$ will continue until one of the conditions in step 228 is satisfied. Should $R_n<R_{init}+R_d$, this is an indication that the previously frozen coil is no longer frozen, i.e., airflow restriction has decreased, and normal cooling can restart.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or feature to the teachings of the disclosure without departing from the scope thereof. Therefore, it is intended that the disclosure not be limited to the particular embodiment(s) disclosed as the best mode contemplated for carrying out this disclosure, but that the disclosure will include all embodiments falling within the scope of the disclosure.

What is claimed is:

1. A method of detecting and responding to a coil condition in an HVAC system, comprising:

calculating an initial airflow restriction value of the HVAC system;

calculating a current airflow restriction value of the HVAC system periodically during a cooling cycle of the HVAC system;

comparing said initial airflow restriction value to said current airflow restriction value, wherein if said current airflow restriction value is greater than a first sum of said initial airflow restriction value and a restriction factor, then the coil condition is preliminarily determined to be freezing, and wherein if said current airflow restriction value is less than a first sum and a restriction factor the coil condition is determined not to be freezing and the HVAC system will continue cooling upon demand, with another current airflow restriction value being calculated periodically for comparison to determine whether the coil condition is preliminarily determined to be freezing or not; and stopping cooling of the HVAC system if the coil condition is preliminarily determined to be freezing;

wherein if the coil condition is preliminarily determined to be freezing, a filter check is performed and a current filter check airflow restriction value is calculated, said current filter check airflow restriction value is compared to a routine filter check airflow restriction value calculated from a periodic filter check performed on the HVAC system, wherein if said current filter check airflow restriction value is greater than a second sum of said routine filter check airflow restriction value and a filter-scaling factor, then cooling of the HVAC system remains stopped, and wherein if said current filter check airflow restriction value is less than said second sum, then cooling of the HVAC system is resumed.

2. The method of claim 1, wherein said restriction factor is $R_d$ calculated using the following equation:

$$R_D = \frac{0.2}{(CFM/1000)^2};$$

wherein CFM is the airflow in cubic feet per minute.

3. The method of claim 1, wherein said filter-scaling factor is $2(R_d)$, $$2(R_D), \text{ wherein } R_D = \frac{0.2}{(CFM/1000)^2};$$

wherein CFM is the airflow in cubic feet per minute.

4. The method of claim 1, wherein an error message is propagated when the HVAC system is stopped and data associated with said error message is stored in a memory device.

5. The method of claim 4, wherein said periodic calculation of the current airflow restriction value continues while said cooling is stopped, and said cooling remains stopped for a set period of time or until said current airflow restriction is less than said last filter check airflow restriction value plus a second restriction factor.

6. The method of claim 5, wherein said second restriction factor is $R_d$, calculated using the following equation:

$$R_D = \frac{0.2}{(CFM/1000)^2};$$

wherein CFM is the airflow in cubic feet per minute.

7. The method of claim 1, further comprising controlling a fan in the HVAC system to remain on while cooling in the HVAC system stops due to the coil condition being preliminarily determined to be freezing.

8. The method of claim 1, wherein said initial airflow restriction value $R_{init}$ and said current airflow restriction value $R_n$ are calculated using the following equation:

$$R_{init} \text{ or } R_n = \frac{\text{static pressure}}{(CFM/1000)^2};$$

wherein CFM is the airflow in cubic feet per minute and static pressure is the pressure drop across the restriction.

9. The method of claim 1, wherein said periodic testing of said airflow restriction occurs every one to five minutes.

10. The method of claim 1, wherein said initial airflow restriction calculation is performed shortly after the HVAC system begins normal cooling.

11. A method of detecting and responding to a coil condition in an HVAC system, comprising:

calculating an initial airflow restriction value and a current airflow restriction value of the HVAC system, wherein the HVAC system has multiple zones, and said multiple zones are factored into the calculation of said initial and said current airflow restriction;

comparing said initial airflow restriction value to said current airflow restriction value, wherein if said current airflow restriction value is greater than a first sum of said initial airflow restriction value and a restriction factor, then the coil condition is preliminarily determined to be freezing, and wherein if said current airflow restriction value is less than a first sum of said initial airflow restriction value and a restriction factor, then the coil condition is determined to not be freezing and the HVAC system will continue cooling upon demand, with another current airflow restriction value being calculated periodically for comparison to determine whether the coil condition is preliminarily determined to be freezing or not;

stopping cooling in the HVAC system if the coil condition is preliminarily determined to be freezing; and comparing a current filter check airflow restriction value to a second sum of a routine filter check airflow restriction value and a filter-scaling factor, wherein if said value of said current filter check airflow restriction value is greater than the second sum, then cooling of the HVAC system remains stopped, and wherein if said current filter check airflow restriction value is less than said second sum, cooling of the HVAC system is resumed.

12. The method of claim 11, wherein said restriction factor is $R_d$ calculated using the following equation:

$$R_D = \frac{0.2}{(CFM/1000)^2};$$

wherein CFM is the airflow in cubic feet per minute.

13. The method of claim 12, further comprising controlling a fan in the HVAC system to remain on while cooling in the HVAC system stops due to the coil condition being preliminarily determined to be freezing.

14. The method of claim 13, wherein said cooling remains off for a set period of time or until said current airflow restriction is less than said routine filter check airflow restriction value minus a second restriction factor.

15. The method of claim 11, wherein said filter-scaling factor is $2(R_d)$, $$2\ (R_D)\text{wherein } R_D = \frac{0.2}{(CFM/1000)^2};$$

wherein CFM is the airflow in cubic feet per minute.

* * * * *